US005562212A

United States Patent [19]

Rösler

[11] Patent Number: 5,562,212

[45] Date of Patent: Oct. 8, 1996

[54] CONTAINER

[75] Inventor: Peter Rösler, Wangen, Germany

[73] Assignee: Rose-Plastic GmbH, Hergensweiler, Germany

[21] Appl. No.: 303,922

[22] Filed: Sep. 9, 1994

[30] Foreign Application Priority Data

Sep. 11, 1993 [DE] Germany ..... 93 13 766.4

[51] Int. Cl.[6] ..... B65D 85/20; B65D 85/28

[52] U.S. Cl. ..... 206/443; 206/379; 220/345; 220/8

[58] Field of Search ..... 206/379, 443; 220/4.03, 4.21, 4.24, 8, 345, 346, 347, 349, 350, 356

[56] References Cited

U.S. PATENT DOCUMENTS

| | | | |
|---|---|---|---|
| 1,450,674 | 4/1923 | Marston | 220/8 |
| 1,838,556 | 12/1931 | Knörer | 206/443 |
| 2,708,026 | 5/1955 | Duell | 220/345 |
| 3,179,278 | 4/1965 | Cohen | 220/8 |
| 3,835,580 | 9/1974 | Keces | 220/4.21 |
| 4,765,501 | 8/1988 | Kao | 220/4.21 |
| 5,248,030 | 9/1993 | Tarozzi | 206/379 |

FOREIGN PATENT DOCUMENTS

| | | | |
|---|---|---|---|
| 2930274 | 3/1981 | Germany | 206/379 |

*Primary Examiner*—Paul T. Sewell
*Assistant Examiner*—Marie Denise Patterson
*Attorney, Agent, or Firm*—Anderson Kill Olick & Oshinsky, P.C.

[57] ABSTRACT

A container for receiving a plurality of elongate objects to be stored parallel to each other and including receiving and closure parts having each complementary two opposite spaced relatively large side walls having each an end section extending perpendicular to the side walls and having a width smaller than a distance between side walls, and two divergent sections extending from opposite ends of the end section and connecting the end section to respective longitudinal ends of the respective side walls of the receiving and closure parts, and with the end sections of the receiving and closure parts having a row of spaced projections, on the outer surfaces, and the end sections of the closure part having at least one boss formed on the inner surfaces of the sections and cooperating with the projections on the outer surfaces of the end sections of the receiving part for connecting the parts together.

5 Claims, 2 Drawing Sheets

CONTAINER

BACKGROUND OF THE INVENTION

The present invention relates to a container formed primarily of a plastic material and having a substantially rectangular parallelpiped shape, and designed for receiving a plurality of elongate objects, arrangeable parallel to each other. The container has a receiving part having an open side and five closed sides, and a plurality of separating walls which extend perpendicular to large side walls of the receiving part and which divide the interior space of the receiving part in a plurality of chambers for receiving each, preferably, one object. The container has also a closure part which relatively tightly covers the receiving part and which is telescopically displaceable along substantially the entire length of the receiving part. Such a container is disclosed in German patent 2,930,274.

The container of the above-described type is used, e.g., for storage and transportation of drills or similar elongate objects. The conventional containers usually are formed in a plurality of different sizes corresponding to sizes of objects to be stored and transported thereon. The receiving and closure parts are conventionally locked in a predetermined longitudinal position. The drawbacks of conventional containers consist in that they cannot be adapted for storage and transportation of objects of different length, and that the locking position of the receiving and closure parts cannot be arbitrary changed.

Accordingly, an object of the invention is a container easily adaptable for storage and transportation of objects of different lengths and having a variable locking position of the receiving and closure parts.

Another object of the invention is a container which is easily lockable and unlockable and which is adapted for use in an automatic packaging process.

SUMMARY OF THE INVENTION

These and other objects of the invention, which will become apparent hereinafter, are achieved by providing a container of the above-described parts in which the receiving part has two opposite spaced relatively large side walls, and two opposite end walls, which extend substantially transverse to the side walls and connect the opposite longitudinal ends of the side walls, each of the end wall of the receiving part having an end section extending perpendicular to the side walls and having a width smaller than a distance between the complementary side walls, and two divergent sections extending from opposite ends of the end section and connecting the end section to respective longitudinal ends of the side walls of the receiving part, and with each of the end sections having an outer surface and a row of spaced projections provided along a longitudinal extent of the outer surface; and the closure part has likewise two opposite spaced relatively large side walls complementary to the side walls of the receiving part and two opposite end walls complementary to the end walls of the receiving part, which extend substantially transverse to the complementary side walls and connect the opposite longitudinal ends of the complementary side walls, with each of the complementary end wall of the closure part having an end section complementary to the end section of the receiving part and extending perpendicular to the complementary side walls and having a width smaller than a distance between side walls, and two divergent sections complementary to the divergent sections of the receiving part and extending from opposite ends of the complementary end section and connecting the ends of the complementary end section to respective longitudinal ends of the complementary side walls and with the complementary end section having an inner surface and at least one boss formed thereon for cooperating with the projections on the outer surface of the respective end section of the receiving part for releasably locking the receiving and closure parts together.

BRIEF DESCRIPTION OF THE DRAWINGS

The features and objects of the present invention will become more apparent, and the invention itself will be best understood from the following detailed description of the preferred embodiment when read with reference to the accompanying drawings, wherein.

Figure 4:
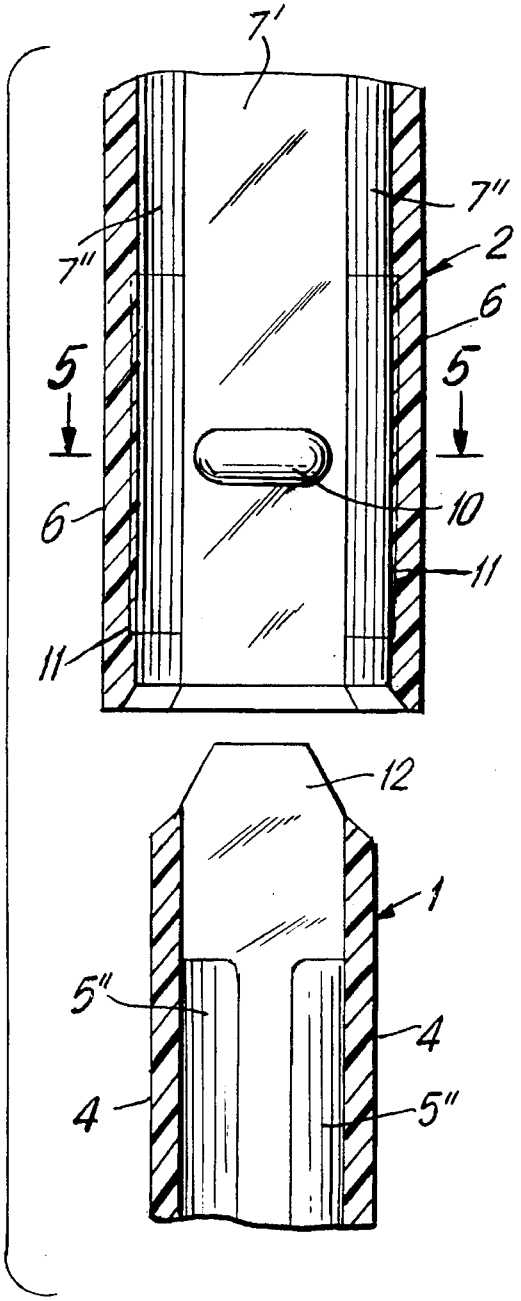
FIG. 4 is a partial cross-sectional view at an increased scale of a relative position of associated container receiving and closure parts in a condition immediately before their connection.
Figure 6:
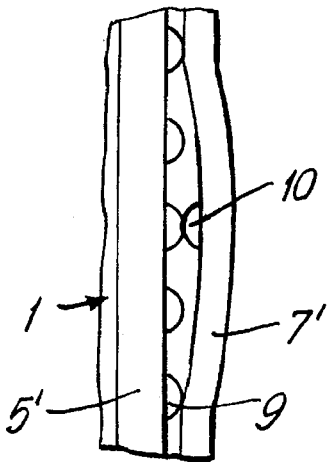

FIG. *5a* is a cross-sectional view along line 5—5 in FIG. 4;

FIG. *5b* is a partial cross-sectional view similar to that of FIG. *5a* but showing divergent sections of the receiving and closure parts formed as accurate sections; and FIG. 6 is a partial view, at an increased scale, showing an intermediate position of locking elements of the two parts during their locking connection.

DETAILED DESCRIPTION OF THE PREFERRED EMBODIMENT

Figure 1:
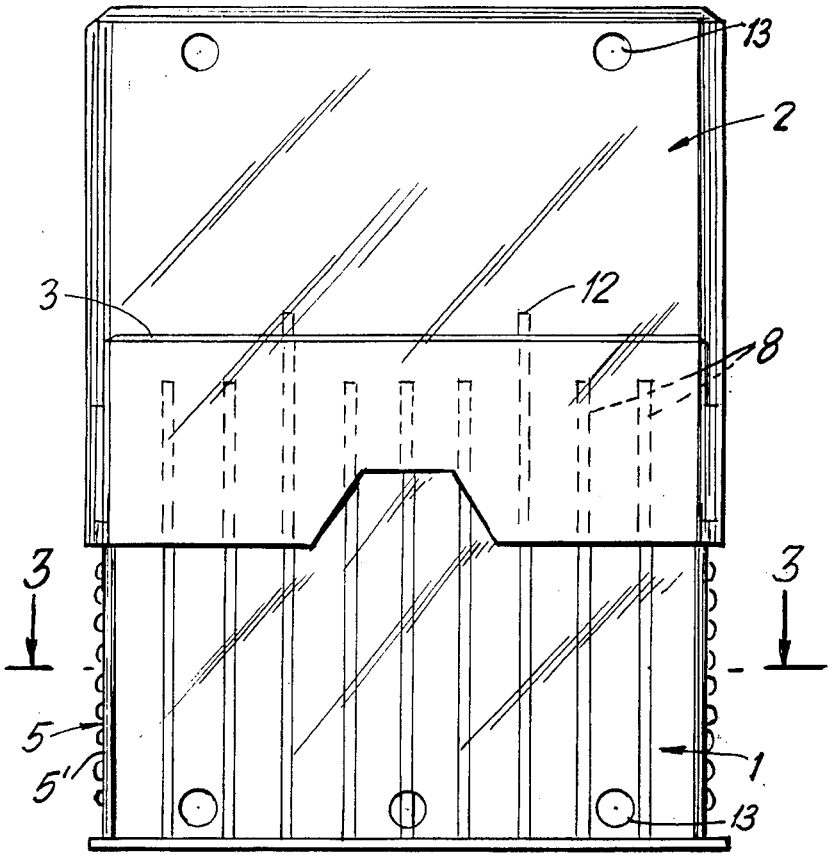
FIG. 1 is a front elevational view of a container according to the present invention.
Figure 3:
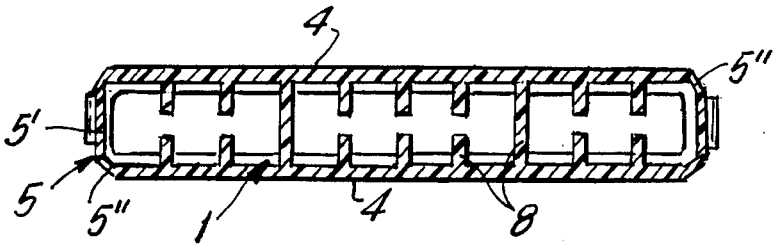
FIG. 3 is a cross-sectional view along line 3—13 in FIG. 1.

A container according to the present invention, which is shown in FIG. 1 is formed as a rectangular substantially flat parallelpiped. The container consists of a package receiving part 1 and a closure part 2 connectable with the package receiving part 1. The package receiving part 1 has an open transverse end side 3, relatively large opposite side walls 4, and two opposite end walls 5, which connect the opposite side walls 4. The closure part 2 has likewise an open end side, two large side walls 6, and two opposite end walls 7, which connect the side walls 6. The closure part is so dimensioned that it envelops the receiving part 1 rather tightly so, that the mutually abutting large side walls of the parts 1 and 2 adjoin each other rather tightly but still can be easily displaced relative to each other.

Figure 5A:
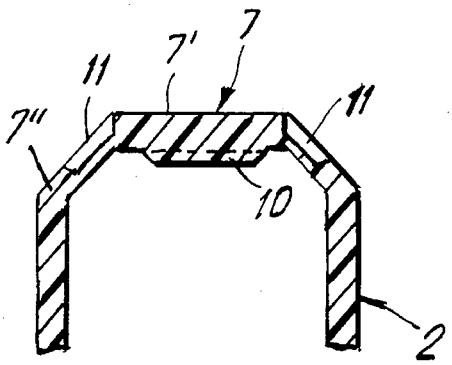
Figure 5B:
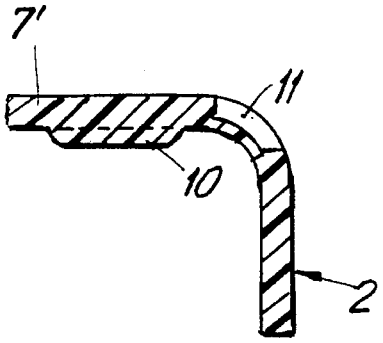

The receiving part 1 has a plurality of separating walls 8 which extend perpendicular to the large sides 4 and parallel to the end walls 5. The separating walls 8 can be formed either as continuous walls, extending between the opposite large side walls 4 or as walls projecting from the opposite side walls 4 into the space of the receiving part with a gap between the opposite aligned separating walls 8. The small end walls 5 of the received part 1 and the small end walls 7 of the closure part 2 have each an end section 5' and 7', respectively, which extends perpendicular to the large side walls 4 and 6 and parallel to the separating walls 8. The end sections 5' and 7' have a width which is smaller than the distance between inner surfaces of the opposite side walls 4 and 6, respectively. The end sections 5' and 7' are connected to the opposite side walls 4 and 6, respectively, by divergent planar sections 5" and 7", respectively As shown in FIG. 1, the divergent sections 5" and 7" form, with the respective walls 4 and 6, an obtuse angle. However, the divergent sections may have a radius of curvature and smoothly connect the end sections with the large side walls as shown in FIG 5*b*.

The end section 5' of the receiving part 1 has, on its outer surface, a row of projections 9, which are spaced from each other and have, preferably, a circular shape. The projections 9 are so arranged on opposite end sections 5 that they coincide with each other.

The closure part 2 has, adjacent to its open end side, on its opposite end sections 7', an aligned or corresponding boss 10, which extend into the space between adjacent projections 9, when the two parts 1 and 2 are connected with each other, to retain the two parts 1 and 2 together in a predetermined position thereof, thus enabling providing a container of an arbitrary length. While only one boss is provided on each end section 7' in the disclosed embodiment, a plurality of bosses may be provided on each end section 7'.

To enable the displacement of the receiving and closure parts, which are, preferably, made of a relatively rigid plastic materials, and their locking connection, the projections 9 on one of the parts, receiving part 1, and the bosses 10 on the other of the two parts, the closure part 2 should permit their relative displacement. To this end, according to the invention, wall thickness diminutions 11 are provided in the in the outer surface of divergent sections 7" of the closure part 2 in the region of each bosses 10 and, specifically, before and behind each boss, with reference to the displacement direction of the container parts. Providing the wall thickness diminutions, results in the appearance of lamellar or membrane like planar regions, which give the boss carrying end sections 7' a necessary elasticity and permit a disconnecting movement of the bosses, as shown in FIG. 6. The wall thickness diminutions 11 start at the connection position between the end sections 7' and the divergent section 7" and extend into the section 7" but not up to the side walls.

The containers according to the invention described above have a plurality of separate chambers which are formed in the receiving part 1 and have predetermined lengths and widths, with the receiving and closure parts themselves having predetermined dimensions. Such a container is suitable for packaging a plurality of elongate objects, e.g., drills, having different lengths and diameters. The projections on the receiving part and the bosses on the closure part insure easy closing of the container in a plurality of longitudinal positions and its easy disconnecting of the receiving and closure part. The container according to the invention can be used in an automatic packaging process. It should be clear that the dimensions of the receiving and closure parts as well as the dimensions of chambers, formed in the receiving part, can vary within large limits for accommodating different sizes of packaged objects.

Figure 2:
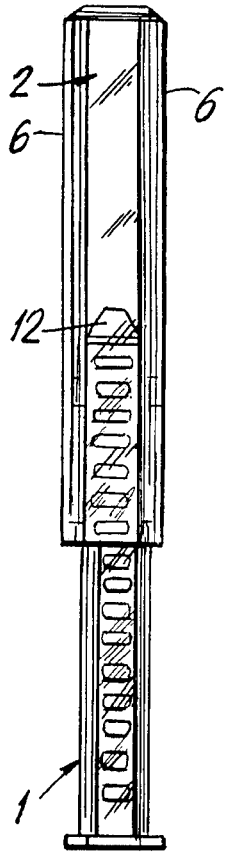
FIG. 2 is a side view of the container which is made of a transparent material and which is shown in FIG. 1.

Having in mind automatic packaging, it is advantageous to provide auxiliary means, especially in containers with a relatively large width of the side walls, which provides for deformation of the side walls of the closure part, due to inherent properties of a plastic material usually utilized for manufacturing of the containers, inwards towards each other. This, however, can hinder telescopic displacement of the closure part relative to the receiving part. To provide for telescopic displacement of the closure part, some of the separating walls can be formed so that they would project above the rim of the opening of the receiving part 1, with the projecting above the rim portions 12 forming guide tongues. The edges of the portions 12 converge toward each other so that, in side view, these projecting portions have a shape of a truncated cone, as shown in FIGS. 2 and 4.

The openings 13, which are per se known and serve for receiving cores during the injection molding process, can be used for holding the main part of the container during the automatic packaging process.

While the present invention was shown and described with reference to the preferred embodiment, various modifications will be apparent to those skilled in the art and, therefore, it is not intended that the invention be limited to the disclosed embodiment and/or details thereof, and departures can be made therefore within the spirit and scope of appended claims.

What is claimed is:

1. A container for receiving a plurality of elongate objects to be stored parallel to each other, said container having a substantially rectangular parallelpiped shape and comprising:

a receiving part having an open side through which the objects are placed into container, two opposite spaced relatively large side walls, and two opposite end walls, which extend substantially transverse to said side walls and connect the opposite longitudinal ends of the side walls, each of the end wall of the receiving part having an end section extending perpendicular to the side walls and having a width smaller than a distance between side walls, and two divergent sections extending from opposite ends of the end section and connecting the end section to respective longitudinal ends of the side walls of the receiving part, and each of the end sections having an outer surface, and a row of spaced projections provided along a longitudinal extent of the outer surface of the end section;

a plurality of spaced separating walls arranged within a space of the receiving part and extending perpendicular to the side walls to form a plurality of separate chambers for receiving each a stored object; and a closure part for relatively tightly closing the receiving part and telescopically displaceable substantially along an entire longitudinal extent of the receiving part, the closure part having two opposite spaced relatively large side walls complementary to the side walls of the receiving part and two opposite end walls complementary to the end walls of the receiving part, which extend substantially traverse to the complementary side walls and connect the opposite longitudinal ends of the complementary side walls, each of the complementary end wall of the closure part having an end section complementary to the end section of the receiving part and extending perpendicular to the complementary side walls and having a width smaller than a distance between the complementary side walls, and two divergent sections complementary to the divergent sections of the receiving part and extending from opposite ends of the complementary end section and connecting the ends of the complementary end section to respective longitudinal ends of the complementary side walls, and the complementary end section of the closure part having an inner surface and at least one boss formed thereon for cooperating with the projections on the outer surface of respective end section of the receiving part for releasible locking the receiving and closure parts together;

wherein the divergent sections of the closure part have, in region of each boss, a wall thickness diminution; and wherein the wall thickness diminution extends from a connection location between the end section and the divergent section of the closure part and across a portion of a width of the divergent section.

2. A container as set forth in claim 1, wherein the divergent sections of the receiving and closure parts extend to respective side walls of the receiving and closure parts and respective end section of the receiving and closure part at an angle.

3. A container as set forth in claim 1, wherein the divergent sections of the receiving and closure parts are formed as arcuate sections having a radius of curvature.

4. A container as set forth in claim 1, wherein the wall thickness diminution is formed in outer surfaces of the divergent sections of the closure part before and behind the bosses in a displacement direction of the closure part.

5. A container for receiving a plurality of elongate objects to be stored parallel to each other, said container having a substantially rectangular parallelpiped shape and comprising:

a receiving part having an open side through which the objects are placed into container, two opposite spaced relatively large side walls, and two opposite end walls, which extend substantially transverse to said side walls and connect the opposite longitudinal ends of the side walls, each of the end wall of the receiving part having an end section extending perpendicular to the side walls and having a width smaller than a distance between side walls, and two divergent sections extending from opposite ends of the end section and connecting the end section to respective longitudinal ends of the side walls of the receiving part, and each of the end sections having an outer surface, and a row of spaced projections provided along a longitudinal extent of the outer surface of the end section;

a plurality of spaced separating walls arranged within a space of the receiving part and extending perpendicular to the side walls to form a plurality of separate chambers for receiving each a stored object; and a closure part for relatively tightly closing the receiving part and telescopically displaceable substantially along an entire longitudinal extent of the receiving part, the closure part having two opposite spaced relatively large side walls complementary to the side walls of the receiving part and two opposite end walls complementary to the end walls of the receiving part, which extend substantially traverse to the complementary side walls and connect the opposite longitudinal ends of the complementary side walls, each of the complementary end wall of the closure part having an end section complementary to the end section of the receiving part and extending perpendicular to the complementary side walls and having a width smaller than a distance between the complementary side walls, and two divergent sections complementary to the divergent sections of the receiving part and extending from opposite ends of the complementary end section and to respective longitudinal ends of the complementary side walls, and the complementary end section of the closure part having an inner surface and at least one boss formed thereon for cooperating with the projections on the outer surface of respective end section of the receiving part for releasible locking the receiving and closure parts together;

wherein some of the separating walls project above a rim of the open side of the receiving part, a projecting portion of each of the projecting walls having convergent toward each other edges.

* * * * *